US011180302B2

(12) United States Patent
Gish et al.

(10) Patent No.: US 11,180,302 B2
(45) Date of Patent: Nov. 23, 2021

(54) COLLAPSIBLE CONTAINER CARRIER

(71) Applicant: Gish LLC, Newport, KY (US)

(72) Inventors: Brian Gish, Newport, KY (US); Joshua J. Haldeman, Loveland, OH (US)

(73) Assignee: Brian Gish, Newport, KY (US)

( * ) Notice: Subject to any disclaimer, the term of this patent is extended or adjusted under 35 U.S.C. 154(b) by 0 days.

(21) Appl. No.: 16/704,617

(22) Filed: Dec. 5, 2019

(65) Prior Publication Data

US 2020/0346828 A1 Nov. 5, 2020

Related U.S. Application Data

(60) Provisional application No. 62/843,517, filed on May 5, 2019.

(51) Int. Cl.

| | |
|---|---|
| ***B65D 71/50*** | (2006.01) |
| ***B65D 25/28*** | (2006.01) |
| ***B65D 21/08*** | (2006.01) |

(52) U.S. Cl.

CPC ..... *B65D 71/50* (2013.01); *B65D 21/086* (2013.01); *B65D 25/2802* (2013.01)

(58) Field of Classification Search

CPC ..... B65D 71/50; B65D 71/00; B65D 21/086; B65D 25/2802; B65D 71/0003

USPC ..... 206/142, 163, 174, 427

See application file for complete search history.

(56) References Cited

U.S. PATENT DOCUMENTS

| | | | | |
|---|---|---|---|---|
| 1,625,359 | A | 4/1927 | Gerding | |
| 2,395,601 | A | 2/1946 | Wenthe | |
| 2,431,231 | A * | 11/1947 | Darnell | B65D 71/0003 206/174 |
| 3,203,582 | A * | 8/1965 | Waggner, III | B65D 71/50 206/159 |
| 3,251,504 | A | 5/1966 | Sankey | |
| 3,951,259 | A * | 4/1976 | Oglesbee | B65D 71/50 206/164 |
| 4,560,064 | A * | 12/1985 | Peterson | A47G 23/0266 206/144 |
| 4,676,375 | A | 6/1987 | Willems et al. | |
| 4,972,781 | A | 11/1990 | Montgomery et al. | |
| 5,207,333 | A | 5/1993 | Peng | |
| 7,007,771 | B2 | 3/2006 | Rawlings et al. | |

(Continued)

*Primary Examiner* — Steven A. Reynolds
(74) *Attorney, Agent, or Firm* — Frost Brown Todd LLC

(57) ABSTRACT

A collapsible device including a frame, a pair of upper support structures, a pair of lower support structures, and a handle. Each upper support structure includes ring members each being configured to receive a container when the upper support structure is in an extended position. Each upper and lower support structure is configured to pivot between a retracted position and an extended position. The handle is movable between a retracted and an extended position independently of the upper and lower support structures. The upper and lower support structures in the extended positions are configured to cooperate to support at least one container. Each upper support structure is configured to overlap with a lower support structure when both are in the retracted position. When extended, the handle is configured to be grasped by a user to transport the device with the upper and lower support structures in the extended position.

20 Claims, 9 Drawing Sheets

(56) References Cited

U.S. PATENT DOCUMENTS

| | | | |
|---|---|---|---|
| 2005/0211576 | A1 | 9/2005 | Paquette |
| 2009/0014341 | A1 | 1/2009 | Raymond et al. |

* cited by examiner

COLLAPSIBLE CONTAINER CARRIER

PRIORITY

This application claims the benefit of U.S. Provisional App. No. 62/843,517, entitled "Portable Can and Bottle Carrier," filed May 5, 2019, the disclosure of which is incorporated by reference herein.

BACKGROUND

There are many devices for carrying beverage containers. An individual may choose to use a cooler when they want to keep the beverages cold. However, coolers are bulky and not particularly portable. Individuals may then choose to use a neoprene pack or similar device, which is less bulky, but still inconvenient to carry around. In a highly mobile society, individuals often find themselves on the go, having a few beverages at one location, then heading to another location. For these individuals, coolers are bulky and inconvenient to carry around from place to place and neoprene packs still need to be carried around after the beverages have been completed and the containers disposed. There is a need for a device that can carry containers on the go and that is able to collapse for easy transport once the beverages have been consumed.

While various types of collapsible container carriers have been made and used, it is believed that no one prior to the inventor(s) has/have made or used the invention described herein.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

FIG. 6 depicts a perspective view of the collapsible device of FIG. 1 in a partially extended configuration in which the device is holding one container and showing the handle fully extended and being grasped by the hand of a user;

Figure 1:
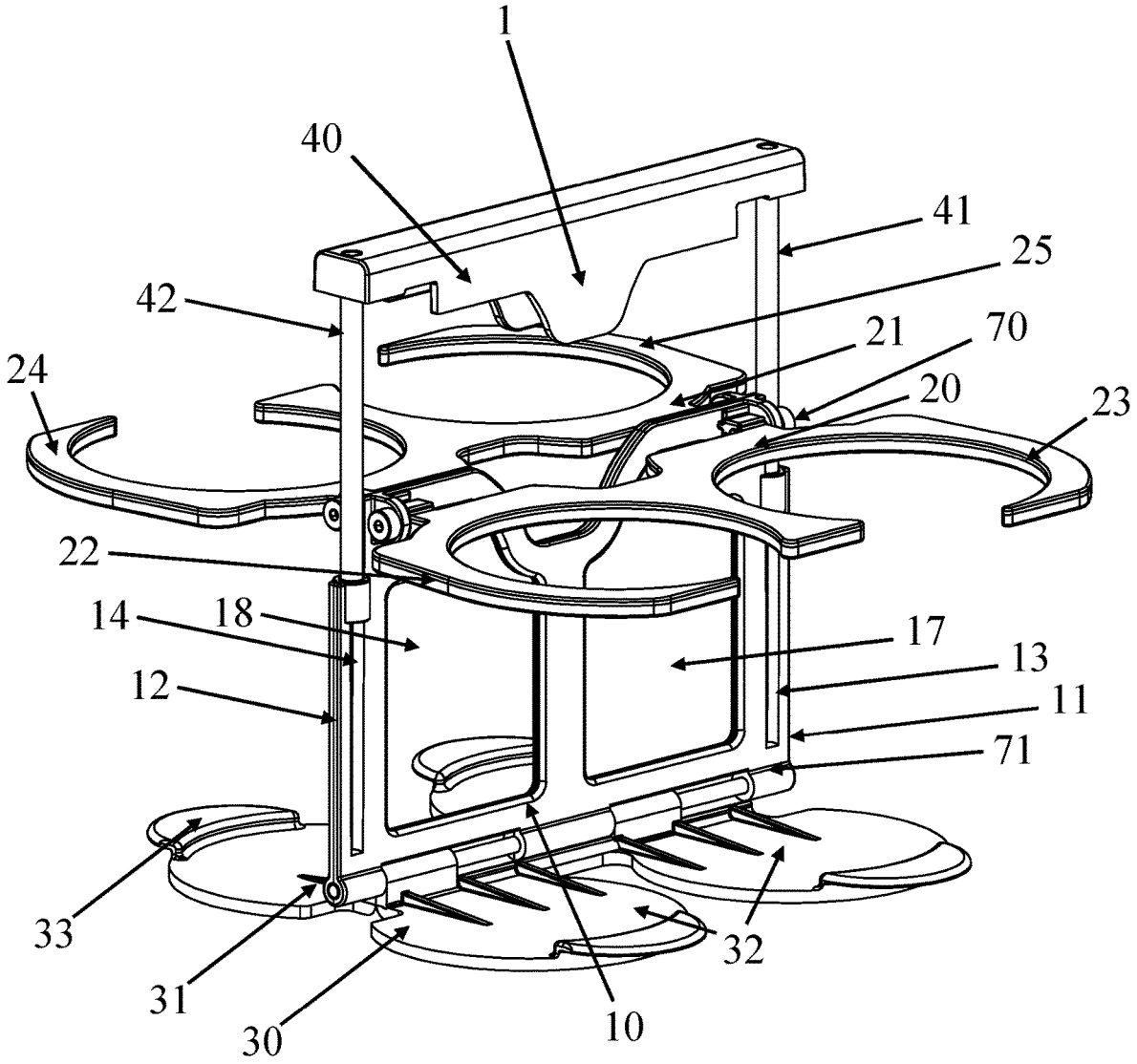
FIG. 1 depicts a perspective view of a collapsible device for holding containers in its fully extended configuration according to a first exemplary embodiment of the present invention.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

To the extent that spatial terms such as "top," "bottom," "upper," "lower," "vertical," "horizontal," and the like are used herein with reference to the drawings, it will be appreciated that such terms are used for exemplary description purposes only and are not intended to be limiting or absolute. In that regard, it will be understood that devices such as those disclosed herein may be used in a variety of orientations and positions not limited to those shown and described herein. In that regard, it will be understood that devices such as those disclosed herein may be used in a variety of orientations and positions not limited to those shown and described herein.

Furthermore, the terms "about," "approximately," and the like as used herein in connection with any numerical values or ranges of values are intended to encompass the exact value(s) referenced as well as a suitable tolerance that enables the referenced feature or combination of features to function for the intended purpose described herein.

I. Exemplary Collapsible Device for Carrying Containers

FIG. 1 shows an exemplary collapsible device (1) for holding containers (C) such as cylindrical beverage containers including bottles, cans, and the like, for example as shown in FIGS. 3-6 described below. As described in greater detail below, device (1) is configured to transition between a fully expanded (or "extended") configuration shown in FIG. 1, and a compact, fully collapsed (or "retracted") configuration shown in FIG. 2A. As also described below, device (1) is further configured to assume various partially extended configurations to accommodate the needs of a user. Advantageously, device (1) may be quickly manipulated into the fully extended configuration or a partially extended configuration to support and provide for easy transport of one or more containers (C). Thereafter, when transport of such containers (C) is no longer necessary, device (1) may be collapsed into the retracted configuration so that device (1) may be conveniently stored and/or transported itself, such as within a pocket or a bag of the user. Furthermore, while device (1) is shown and described herein as being configured to support and transport cylindrical beverage containers (C), it will be appreciated by those of ordinary skill in the art that the features of collapsible device (1) may be suitably configured in other versions to support and transport containers (C) of various other geometries.

FIG. 1 shows a collapsible device (1) in its fully extended configuration. The device (1) comprises a frame (10); a pair of upper support structures (20, 21) pivotably coupled to opposed lateral sides of the frame (10); a pair of lower support structures (30, 31) pivotably coupled to opposed lateral sides of the frame (10); and a handle (40) slidably coupled to the frame (10). The frame (10) has a first elongate vertical channel (13) adjacent to its first end (11) and a second elongate vertical channel (14) adjacent to its second end (12). The first channel (13) slidably receives a first rail (41) that extends downwardly from the first end of the handle (40), and the second channel (14) slidably receives a second rail (42) that extends downwardly from an opposed second end of the handle (40). Channels (13, 14) are configured to slidably guide rails (41, 42) vertically relative to frame (10) and thereby enable the handle (40) to transition between a retracted position shown in FIG. 2A and an extended position shown in FIG. 1. The frame (10) includes a pair of openings (17, 18) configured to receive portions of the lower support structures (30, 31) in their retracted positions, which promotes a compact configuration of the device in its fully retracted state.

The first upper support structure (20) includes a first pair ring members (22, 23), and the second upper support structure (21) includes a second pair of ring members (24, 25). Each ring member (22, 23, 24, 25) defines a generally circular opening configured to receive and constrain a respective container relative to the frame (10) when device (1) is in an at least partially extended configuration, for example shown in FIG. 3.

Each lower support structure (30, 31) of the present version includes a pair of generally circular bases (32), each of which has a raised lip (33) at an outer end thereof. Each base (32) is configured to support the lower end of a container constrained within the circular opening of a respective ring member (22, 23, 24, 25) of the corresponding upper support structure (20, 21). Accordingly, the bases are configured to cooperate with the ring members (22, 23, 24, 25) to support a plurality of containers (C) in a vertical orientation, such that the longitudinal axis of each container (C) is supported parallel to a height of the frame (10).

Figure 2A:
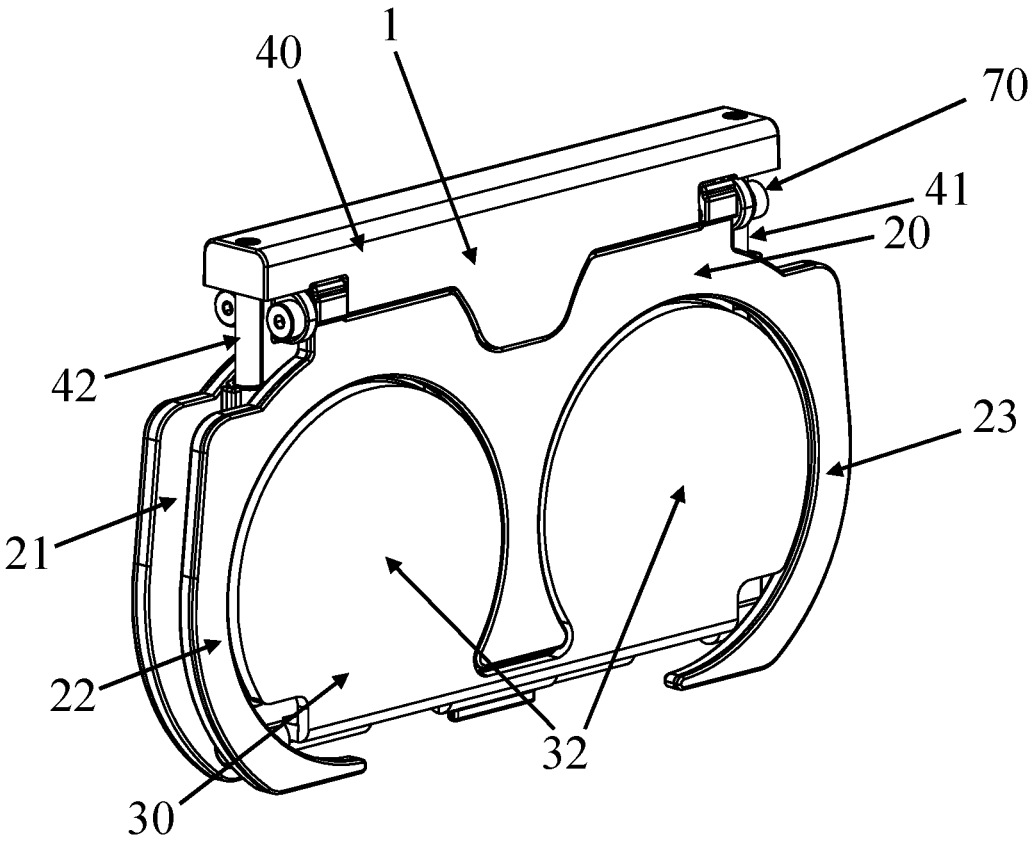
FIG. 2A depicts a perspective view of the collapsible device of FIG. 1 in its fully retracted configuration.
Figure 2B:
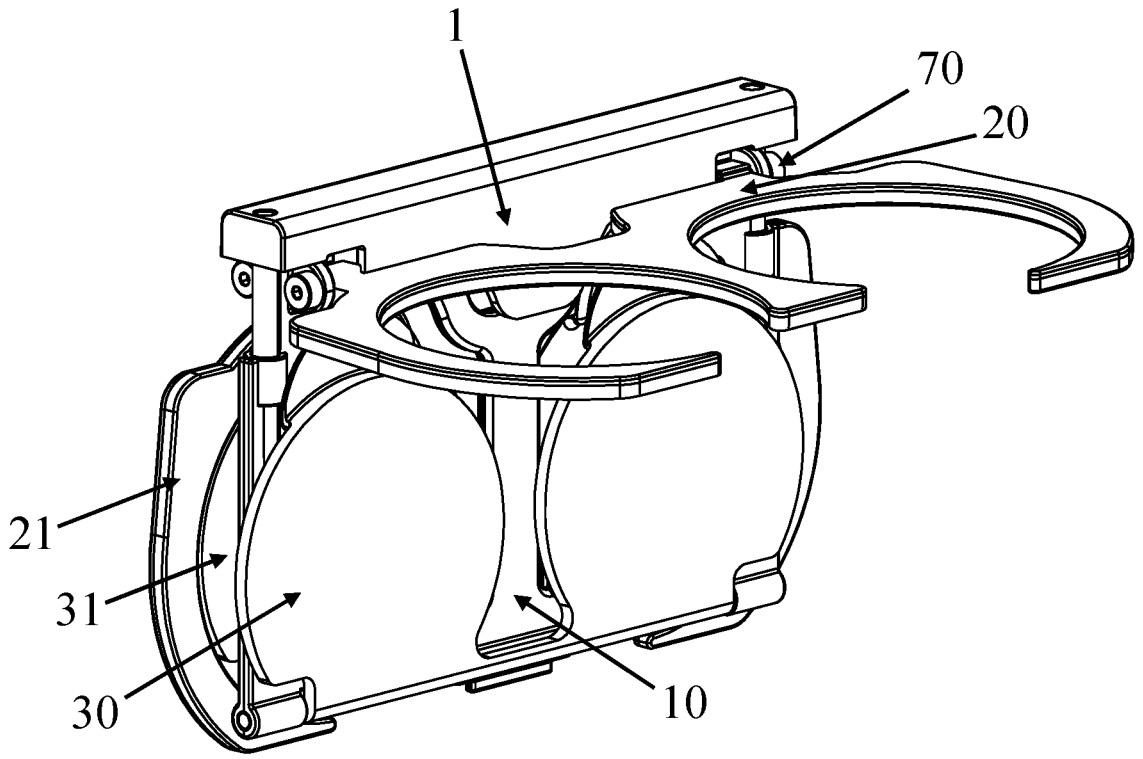
FIG. 2B depicts a perspective view of the collapsible device of FIG. 1 with only one upper support structure extended.

Each upper support structure (20, 21) is pivotably coupled to a respective lateral side of the upper portion (15) of the frame (10) by a pair of upper hinges (70) that allow the upper support structures (20, 21) to pivot between a retracted position (see e.g., FIG. 2A) and an extended position (see e.g., FIG. 2B). Each lower support structure (30, 31) is pivotably coupled to a respective lateral side of the lower portion (16) of the frame (10) by a lower hinge (71) that allows the base (32) to pivot between a retracted position (see e.g., FIG. 2B) and an extended position (see e.g., FIG. 2C). In the present example, each lower support structure (30, 31) is pivotable relative to frame (10) independently of the other support structures (30, 31). Here, each base may be integrally connected with an adjacent base on the same lateral side of frame (10) such that the paired bases (32) pivot together relative to frame (10). Additionally, each ring member (22, 23, 24, 25) and corresponding lower support structure (30, 31) are parallel to a vertical plane that is defined by the frame (10) when in their retracted positions. Each ring member (22, 23, 24, 25) and corresponding lower support structure (30, 31) extend perpendicularly outward from the frame (10) when in their extended positions.

In the fully extended position of the device (1) shown in FIG. 1, the upper support structures (20, 21) and the lower support structures (30, 31) are configured to cooperate to support a plurality of containers (C). Particularly, in the present version of device (1), each upper support structure (20, 21) and the respective lower support structure (30, 31) are configured to support up to two containers (C), such that device (1) is configured to support up to four containers (C). However, it will be appreciated that device (1) may be configured to support various other quantities and configurations of containers (C) in other versions. As also shown in FIG. 1, the handle (40) is in its fully extended position in which it is configured to be grasped by a user to transport the collapsible device (1) while one or both of the upper support structures (20, 21) and one or both of the lower support structures (30, 31) are in the extended positions as well. As described above, the handle (40) is coupled to the frame (10) such that the handle (40) is selectively extendable and retractable relative to the frame (10) independently of the upper support structures (20, 21) and the lower support structures (30, 31).

In FIG. 2A, the device (1) is shown in its fully retracted position in which the upper and lower support structures (20, 21, 30, 31) are fully retracted against frame (10) and handle (40) is fully retracted against frame (10). When each upper support structure (20, 21) and its respective lower support structure (30, 31) are retracted against frame (10), each ring member (22, 23) overlaps its respective base (32), thus providing device (1) with a compact configuration. As shown in FIG. 2A when both a first upper support structure (20) and a first lower support structure (30) are in their retracted positions, the bases (32) of the first lower support structure (30) are received within the circular opening defined by the ring members (22, 23) of the first upper support structure (20).

Figure 2C:
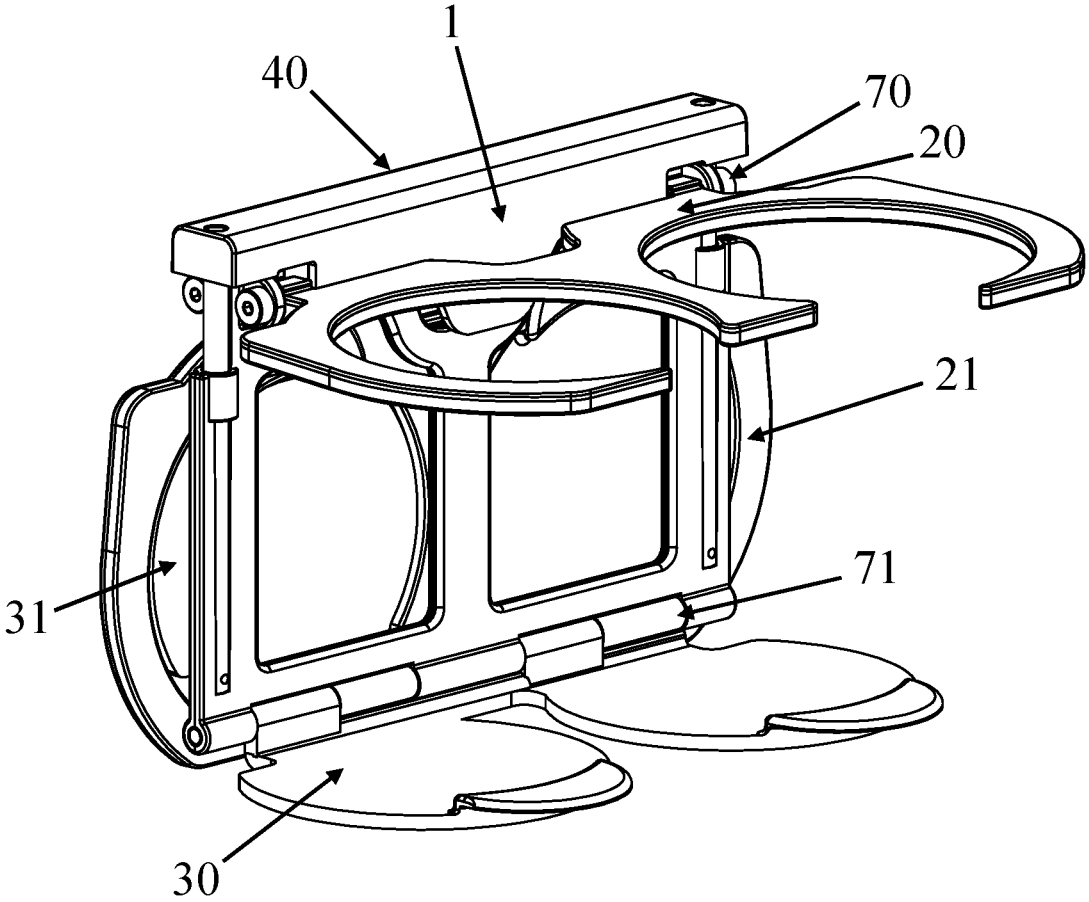
FIG. 2C depicts a perspective view of the collapsible device of FIG. 1 with one upper support structure and one lower support structure extended.

FIG. 2B shows device (1) in the process of being expanded from the fully retracted configuration of FIG. 2A, showing the first upper support structure (20) in an extended position and the first lower support structure (30) in a retracted position. In FIG. 2C, the device is shown in an exemplary partially extended configuration in which the first upper support structure (20) is in an extended position and the first lower support structure (30) is in an extended position. It will be appreciated that handle (40) may be extended with device (1) in such a partially expanded configuration for carrying up to two containers (C), while the second upper and lower support structures (21, 31) remain retracted, for example as shown in FIGS. 3-6 described below.

Figure 3:
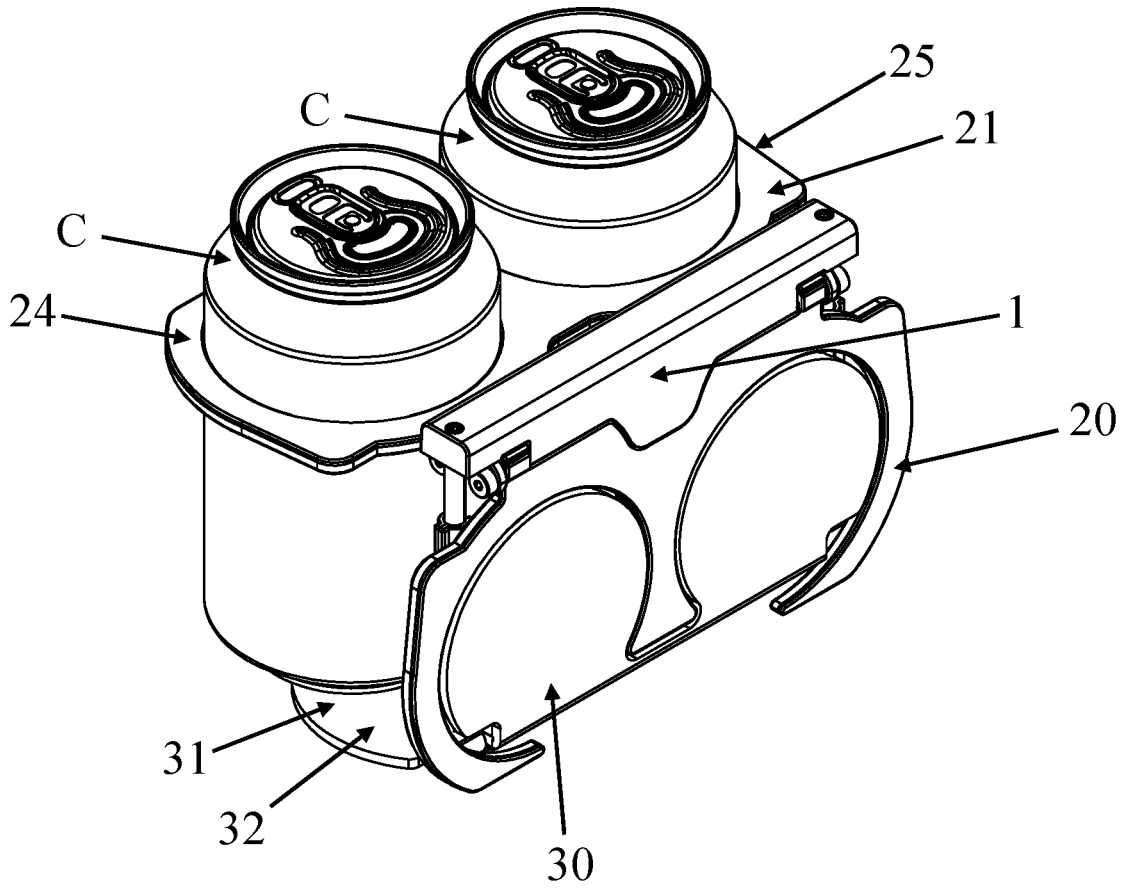
FIG. 3 depicts a perspective view of the collapsible device of FIG. 1 in a partially extended configuration in which the device is holding two containers.
Figure 4:
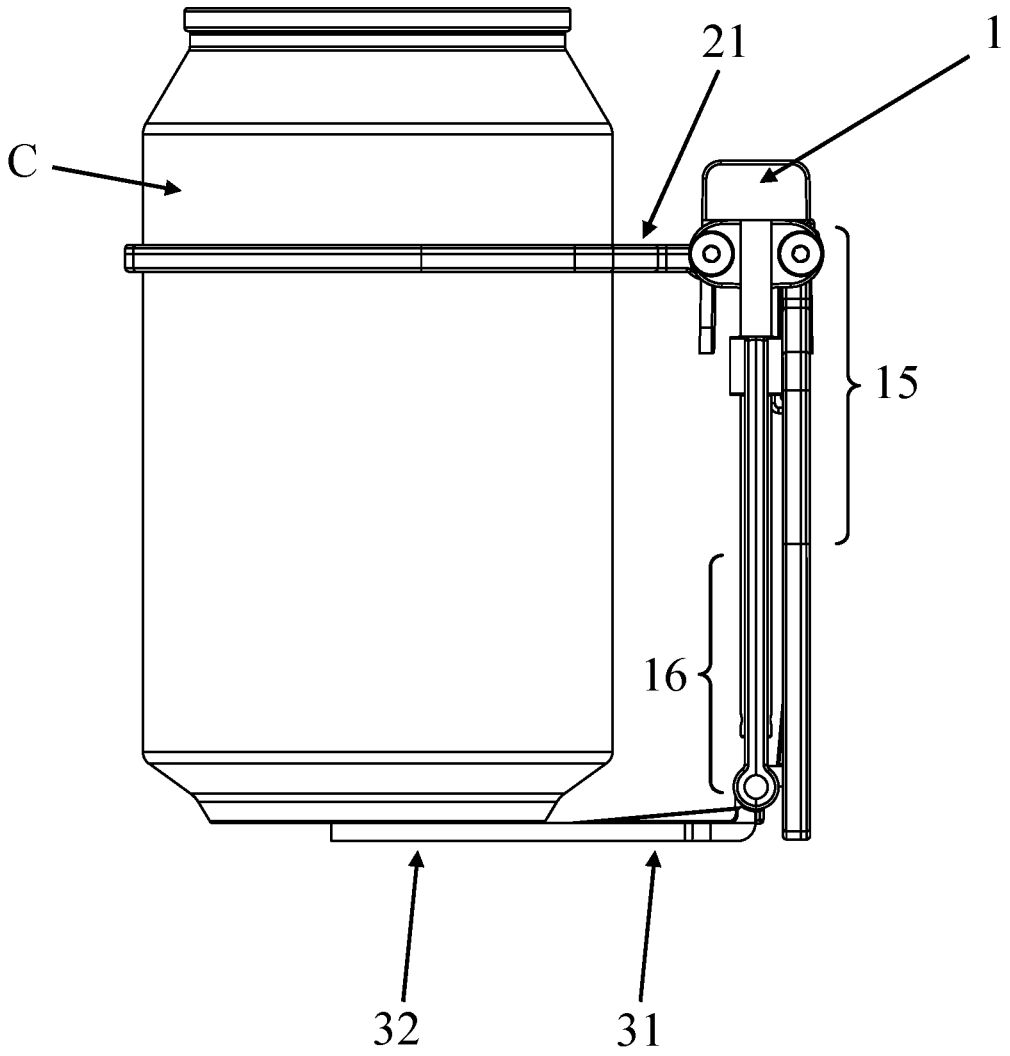
FIG. 4 depicts an end elevation view of the collapsible device of FIG. 1 in a partially extended configuration in which the device is holding a container.
Figure 5:
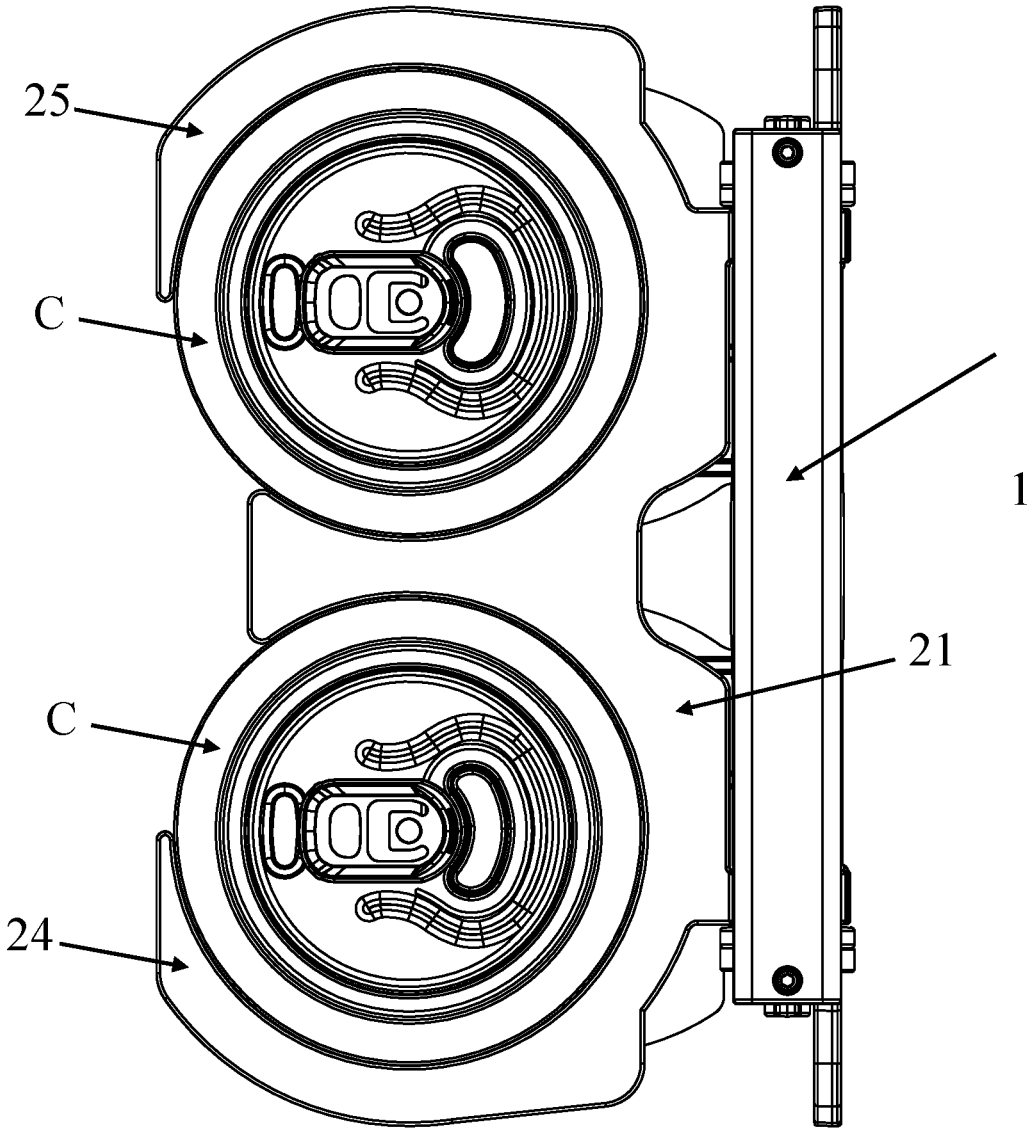
FIG. 5 depicts a top plan view of the collapsible device of FIG. 1 in a partially extended configuration in which the device is holding two containers.

FIGS. 3-6 show the device (1) in another exemplary partially extended position similar to that of FIG. 2C described above. As shown in FIG. 3, the second upper support structure (21) is in an extended position and the second lower support structure (31) is in an extended position, while the first upper and lower support structures (20, 30) remain retracted. Additionally, an exemplary pair of containers (C) are shown retained by the ring members (24, 25) of the second upper support structure (21) and the bases (32) of the second lower support structure (31) functioning in cooperation. In particular, each ring member (24, 25) laterally supports and constrains the upper end of a respective container (C), and the corresponding base (32) vertically supports and constrains the lower end of the container (C). Furthermore, the raised lip (33) of each base (32) (see FIG. 1 and FIG. 2C) may impose at least a minimum additional degree of lateral constraint on the lower end of the respective container (C) supported on the base (32), thereby further securing the container (C) relative to frame (10) to ensure that the container (C) does not shift during transport.

As shown in FIGS. 3-6, the device (1) may be used to transport a pair of containers (C) using only support structures (21, 31) on a first lateral side of the frame (10), thus permitting the unused support structures (20, 30) on the opposing lateral side to remain collapsed against the frame (10). Advantageously, this enables the device (1) to maintain a compact configuration during use, thereby permitting the user to easily carry the device (1) along his or her side. However, it will be appreciated that in other applications a first container (C) may be supported on a first lateral side of the device (1) while a second container (C) is supported on the opposed second lateral side of the device (1). Advantageously, such an arrangement of first and second containers (C) may provide the loaded device (1) with a center of gravity disposed along the central plane defined by the frame (10), thus preventing lateral tipping of the device (1) during transport. With regard to the various exemplary embodiments disclosed herein, it will be appreciated that a plurality of containers (C) may be supported by the respective device (1, 100, 200) using any desired combination of the support features of the device (1, 100, 200).

Furthermore, it will be appreciated by persons of ordinary skill in the art that the components of the collapsible device (1) and the additional collapsible devices (100, 200) described below may be formed of various suitable combinations of one or more materials such as polymers, metals, and/or woods, via various suitable manufacturing methods. For instance, and by way of example only, frame (10), support structures (20, 21, 30, 31), and handle (40) may be formed of a polymer, such as a plastic, having a minimum degree of flexibility, via a suitable molding process (e.g., injection molding). Additionally, in some such versions, rails (41, 42) may be formed of a more rigid material such as a metal. In other versions, the frame (10), support structures (20, 21, 30, 31), and handle (40) may be formed of the same material.

Figure 7:
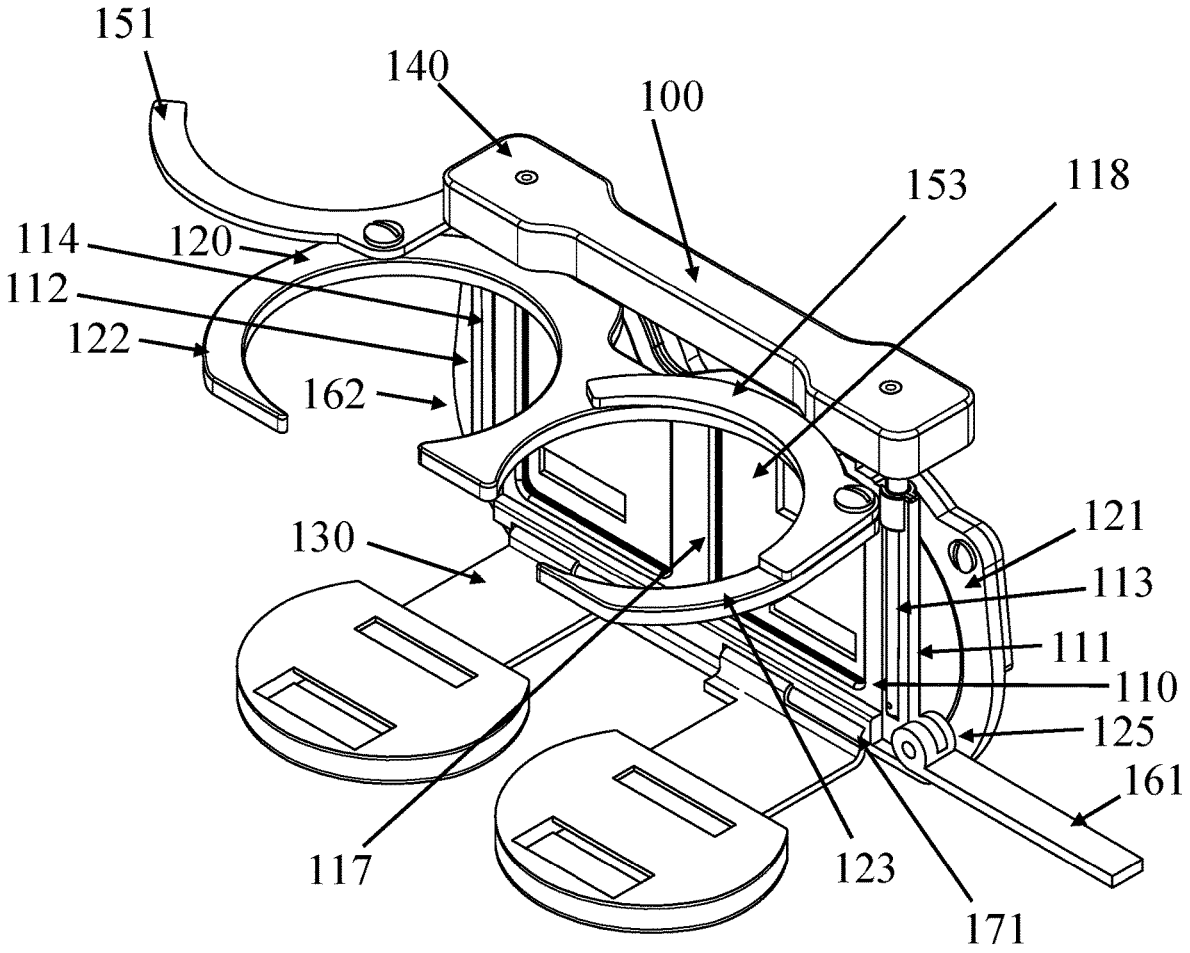
FIG. 7 depicts a perspective view of a collapsible device according to another exemplary embodiment of the present invention in which the device has an end base that pivots relative to the frame, showing the device in a partially extended configuration.

II. Exemplary Collapsible Container Carriers Having Retractable End Support Members FIG. 7 shows another exemplary collapsible device (100) in a partially extended position. This device (100) is similar in structure and function to device (1) described above except as otherwise described below. Similar to device (1), device (100) has a frame (110), a first upper support structure (120) that includes two ring members (122, 123), a second upper support structure (121) that includes two ring members (125 and not shown—see FIG. 8B for an example of a second ring member), a first lower support structure (130), a second lower support structure (Not shown—see FIG. 8B for an example of a second lower support structure), and a handle (140). Each of the upper support structures (120, 121) is pivotably coupled to an upper portion of the frame (110) by a pair of upper hinges (not shown) and is configured to pivot relative to the frame (110) between a retracted position and an extended position. Each of the lower support structures (130, 131) is pivotably coupled to a lower portion of the frame (110) by a lower hinge (171) and is configured to pivot relative to the frame (110) between a retracted position and an extended position. Additionally, the handle (140) is slidably coupled to the frame (110) and is configured to translate relative to the frame (110) between an upper extended position and a lower retracted position. The frame (110) has a first frame side (117), an opposed second frame side (118), a first frame end (111), and an opposed second frame end (112), a first channel (113) adjacent to the first frame end (111), a second channel (114) adjacent to the second frame end (112).

Unlike the collapsible device (1) in FIGS. 1-6, the collapsible device (100) shown in FIG. 7 further includes a first upper end support member (151), a second upper end support member (not shown—see FIG. 8B for an example of a second lower support structure), a third upper end support member (153), a fourth upper end support member (not shown—see FIG. 8B for an example of a second lower support structure), a first end base (161), and a second end base (162). At the first frame end (111) of device (100), the first upper end support member (151) is pivotably coupled to the first upper support structure (120), and the second upper end support member is pivotably coupled to the second upper support structure (121). At the opposed second frame end (112) of device (100), the third upper end support member (153) is pivotably coupled to the first upper support structure (120), and the fourth upper end support member is pivotably coupled to the second upper support structure (121). Accordingly, each upper support structure (120, 121) is configured to pivot relative to frame (110) with its respective upper end support member (151, not shown, 153, not shown). Additionally, each upper end support member (151, not shown, 153, not shown) is configured to pivot relative to its respective upper support structure (120, 121) in a plane parallel to an upper surface of the upper support structure (120, 121). In particular, each upper end support member (151, not shown, 153, not shown) is configured to pivot relative to its respective upper support structure (120, 121) between a retracted position in which the upper end support member (151, not shown, 153, not shown) overlies a corresponding ring member (122, 123, not shown, not shown) of the upper support structure (120, 121); and an extended position in which the upper end support member (151, not shown, 153, not shown), extends at least partially about the respective frame end (111, 112), above the respective end base (161, 162).

The first end base (161) is pivotably coupled to a lower portion of the first frame end (111). The second base end (162) is pivotably coupled to a lower portion of the second frame end (112). Each end base (161, 162) is configured to pivot relative to the respective frame end (111, 112) in a vertical plane defined by frame (110) between an extended position and a retracted position. In the extended position, each lower support structure (130, not shown) is perpendicular to the frame (110). In the retracted position, each lower support structure (130, not shown) is parallel to the frame (110). When fully extended, the first upper end support member (151) and the second upper end support member form a first end ring member having a generally circular opening and being configured to cooperate with the first end base (161) in its extended position to support and secure a container against first frame end (111). Similarly, when fully extended, the third upper end support member (153) and the fourth upper end support member form a second end ring member (156) having a generally circular opening and being configured to cooperate with the second end base (162) to support and secure an additional container against second frame end (112). Accordingly, it will be appreciated that collapsible device (100) is capable of transporting more containers than device (1) while still collapsing into a compact structure of similar size.

Figure 8A:
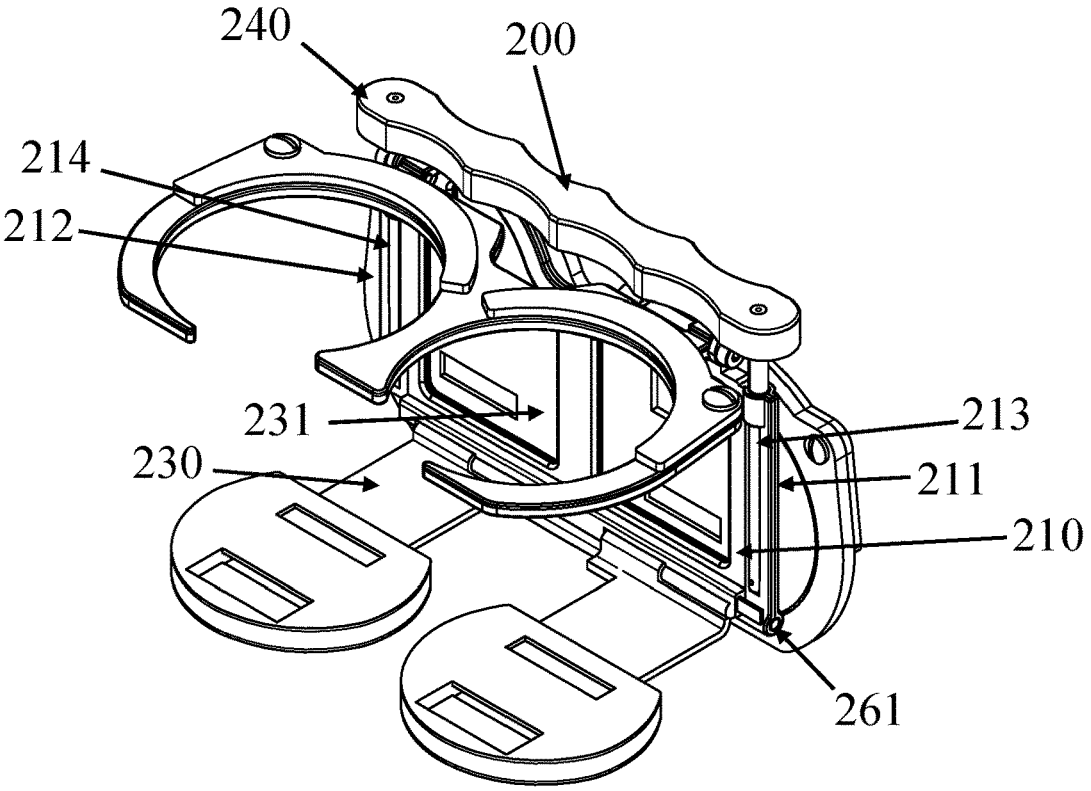
FIG. 8A depicts a perspective view of a collapsible device according to another exemplary embodiment, showing the device in a partially extended configuration in which an end base of the device is retracted inside of the device frame.
Figure 8B:
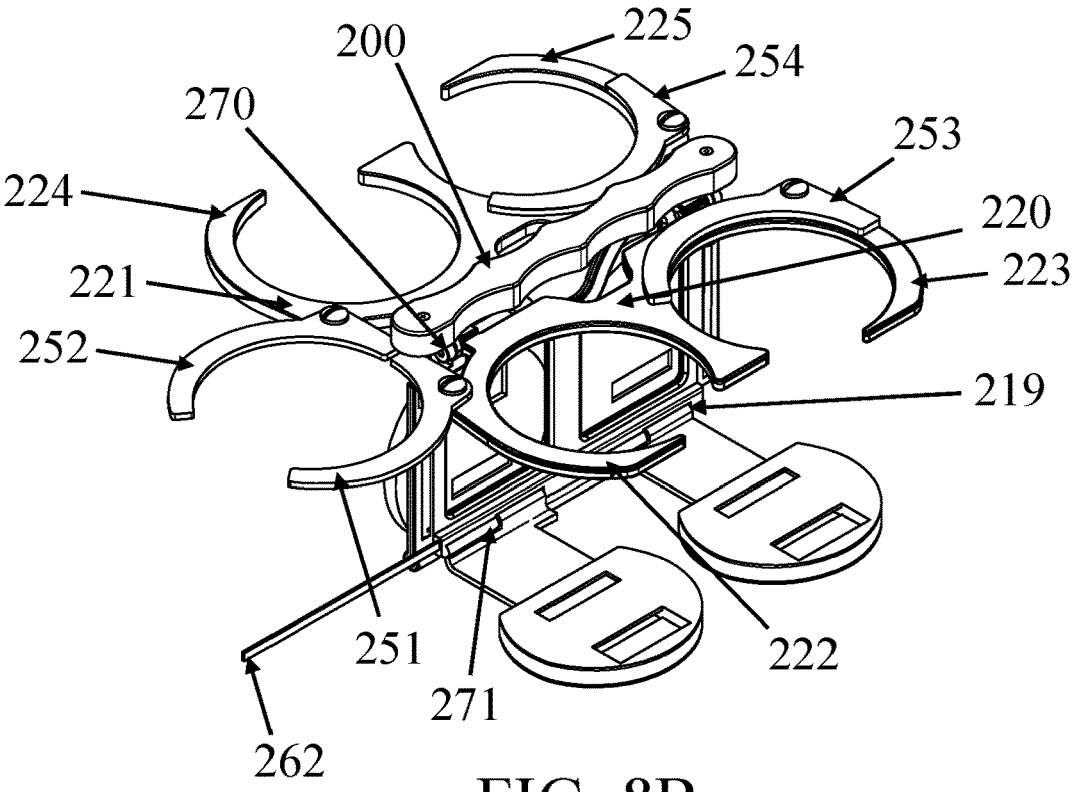
FIG. 8B is a perspective view of the collapsible device of FIG. 8A, showing the device with the end base extended out of the frame.

FIGS. 8A and 8B show yet another exemplary collapsible device (200), which is similar to collapsible device (100) described above except as otherwise described below. Here, the device has a frame (210), a first upper support structure (220) that includes two ring members (222, 223), a second upper support structure (221) that includes two ring members (224, 225), a first lower support structure (230), a second lower support structure (231), a handle (240), a first upper end support member (251), a second upper end support member (252), a third upper end support member (253), a fourth upper end support member (254), a first end base (261, shown in the retracted position) and a second end base (262, shown in the expanded position). The frame (210) has a first channel (213) that extends along the frame height at the first frame end (211), a second channel (214) that extends along the frame height at the second frame end (212), and a third channel (219) that extends perpendicularly to the first and second channels (211, 214) along the length of a lower end of the frame (210). As described below, third channel (219) is open at both ends such that third channel (219) is configured to slidably receive a pair of opposed end bases (261, 262) therein.

Unlike collapsible device (100) shown in FIG. 7, the collapsible device (200) shown in FIG. 8 includes a first end base (261) and a second end base (262) that extend out of the third channel (219) in the extended position and retract into the third channel (219) in the retracted position. The upper support structures (220, 221) are pivotably coupled to the upper portion of the frame (210) by an upper hinge (270) that allows the upper support structures (220, 221) to pivot between a retracted position and an extended position. The lower support structures (230, 231) are pivotably coupled to the lower portion of the frame (210) by a lower hinge (271) that allows the lower support structures (230, 231) to pivot between a retracted position and an extended position. The handle (240) is coupled to the frame (210) such that the handle (240) is movable relative to the frame (210) independently of the upper support structures (220, 221) and lower support structures (230, 231).

Each upper end support member (251, 252, 253, 254) is configured to pivot relative to the frame (210) with its respective upper support structure (220, 221). Additionally, each upper end support member (251, 252, 253, 254) is configured to pivot relative to its respective upper support structure (220, 221) in a plane parallel to an upper surface of the upper support structure (220, 221). In particular, each upper end support member (251, 252, 253, 254) is configured to pivot relative to its respective upper support structure (220, 221) between a retracted position in which the upper end support member (251, 252, 253, 254) overlies a corresponding ring member (222, 223, 224, 225) of the upper support structure (220, 221); and an extended position in which the upper end support member (251, 252, 253, 254) extends at least partially about the respective frame end (211, 212), above the respective end base (261, 262).

The first end base (261) is coupled to the frame (210) in a configuration so that the first end base (261) may pivot in an extended position and a retracted position (shown in FIG. 8A). The second end base (262) is coupled to the frame (210) in a configuration so that the second end base (262) may translatably retract into (FIG. 8A) and extend out from (FIG. 8B) the third channel (219) in the frame (210). When fully extended, the first upper end support member (251) and the second upper end support member (252) form a first end ring member (255) with a circular opening that are configured to cooperate with the first end base (261) to secure a container. When fully extended, the third upper end support member (253) and the fourth upper end support member (254) form a second end ring member with a circular opening that are configured to cooperate with the second end base (262) to secure a container.

III. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLE 1

A collapsible device for holding at least one container comprising: (a) a frame; (b) a pair of upper support structures coupled to an upper portion of the frame, wherein each upper support structure is configured to pivot relative to the frame between a retracted position and an extended position, wherein each upper support structure includes at least one ring member, wherein each ring member defines a circular opening configured to receive a container when the corresponding upper support structure is in the extended position; (c) a pair of lower support structures coupled to a lower portion of the frame, wherein each lower support structure is configured to pivot relative to the frame between a retracted position and an extended position; and (d) a handle coupled to the frame, wherein the handle is movable relative to the frame independently of the upper support structures and the lower support structures between an extended position and a retracted position; wherein the upper support structures and the lower support structures in the extended positions are configured to cooperate to support at least one container; wherein each upper support structure is configured to overlap with a respective lower support structure when the upper and lower support structures are in the retracted position; wherein the handle in the extended position is configured to be grasped by a user to transport the collapsible device with the upper support structures and the lower support structures in the extended position.

EXAMPLE 2

The collapsible device of Example 1, wherein the frame includes a first channel adjacent to a first end of the frame and a second channel adjacent to a second end of the frame, wherein the handle is slidable along the first and second channels.

EXAMPLE 3

The collapsible device of any of the previous Examples, wherein each of the lower support structures is configured to pivot downwardly away from the frame when transitioning from the retracted position to the extended position, wherein each of the lower support structures is further configured to pivot upwardly towards the frame when transitioning from the extended position to the retracted position.

EXAMPLE 4

The collapsible device of Example 3, wherein each of the upper support structures is configured to pivot upwardly away from the frame when transitioning from the retracted position to the extended position, wherein each of the upper support structures is further configured to pivot downwardly towards the frame when transitioning from the extended position to the retracted position.

EXAMPLE 5

The collapsible device of any of the previous Examples, wherein the lower support structures in the extended positions extend parallel to the upper support structures in the extended positions.

EXAMPLE 6

The collapsible device of any of the previous Examples, wherein the frame defines a plane, wherein the handle is slidable along the plane between the extended position and the retracted position.

EXAMPLE 7

The collapsible device of Example 6, wherein the upper support structures and lower support structures are configured to extend perpendicularly to the plane in the extended positions, wherein the upper and lower support structures are configured to extend parallel to the plane in the retracted positions.

EXAMPLE 8

The collapsible device of any of the previous Examples, wherein the at least one ring member includes two ring members.

EXAMPLE 9

A collapsible device for holding at least one container comprising: (a) a frame having a first frame side, a second frame side, a first frame end, and a second frame end; (b) a first upper support structure coupled to an upper portion of the frame on the first frame side, wherein the first upper support structure is configured to pivot relative to the frame between a retracted position and an extended position, wherein the first upper support structure includes at least one ring member, wherein the first upper support structure has a first end and a second end; (c) a second upper support structure coupled to the upper portion of the frame on the second frame side, wherein the second upper support structure is configured to pivot relative to the frame between a retracted position and an extended position, wherein the second upper support structure includes at least one ring member, wherein the second upper support structure has a first end and a second end; (d) a first lower support structure coupled to a lower portion of the frame on the first frame side, wherein the first lower support structure is configured to pivot relative to the frame between a retracted position and an extended position; (e) a second lower support structure coupled to the lower portion of the frame on the second frame side, wherein the second lower support structure is configured to pivot relative to the frame between a retracted position and an extended position; (f) a first end support structure coupled to the first frame end, wherein the first end support structure is movable relative to the frame between an extended position and a retracted position; and (g) a second end support structure coupled to the second frame end, wherein the second end support structure is movable relative to the frame between an extended position and a retracted position; wherein the upper support structures and the lower support structures in the extended positions are configured to cooperate to support at least one first container; wherein the first end support structure is configured to support one second container; wherein the second end support structure is configured to support a third container.

EXAMPLE 10

The collapsible device of Example 9, wherein the first end support structure comprises a first upper end support member and a second upper end support member, wherein the first upper end support member is coupled to the first end of the first upper support structure, wherein the second upper end support member is coupled to the first end of the second upper support structure, wherein the first upper end support member is movable relative to the frame between an extended position and a retracted position, wherein the second upper end support member is movable relative to the frame between an extended position and a retracted position, wherein the first upper end support member in the extended position and the second upper end support member in the extended position are configured to cooperate to define a ring member.

EXAMPLE 11

The collapsible device of Example 10, wherein the second end support structure comprises a third upper end support member and a fourth upper end support member, wherein the third upper end support member is coupled to the second end of the first upper support structure, wherein the fourth upper end support member is coupled to the second end of the second upper support structure, wherein the third upper end support member is movable relative to the frame between an extended position and a retracted position, wherein the fourth upper end support member is movable relative to the frame between an extended position and a retracted position, wherein the third upper end support member in the extended position and the fourth upper end support member in the extended position are configured to cooperate to define a ring member.

EXAMPLE 12

The collapsible device of Example 11, wherein the first end support structure comprises a first upper end support member, a second upper end support member, and a first end base, wherein the first end base is coupled to the lower portion of the first end of the frame, wherein the first end base is movable relative to the frame between an extended position and a retracted position, wherein the first upper end support member, the second upper end support member and the first end base in the extended positions are configured to cooperate to support at least one container.

EXAMPLE 13

The collapsible device of Example 12, wherein the second end support structure comprises a third upper end support member, a fourth upper end support member, and a second end base, wherein the second end base is coupled to the lower portion of the second end of the frame, wherein the second end base is movable relative to the frame between an extended position and a retracted position, wherein the third upper end support member, the fourth upper end support member and the second end base in the extended positions are configured to cooperate to support at least one container.

EXAMPLE 14

The collapsible device of any of Examples 9 through 13, wherein each of the lower support structures is configured to pivot downwardly away from the frame when transitioning from the retracted position to the extended position, wherein each of the lower support structures is further configured to pivot upwardly towards the frame when transitioning from the extended position to the retracted position.

EXAMPLE 15

The collapsible device of Example 14, wherein each of the upper support structures is configured to pivot upwardly away from the frame when transitioning from the retracted position to the extended position, wherein each of the upper support structures is further configured to pivot downwardly towards the frame when transitioning from the extended position to the retracted position.

EXAMPLE 16

The collapsible device of any of Examples 9 through 15, wherein the lower support structures in the extended positions extend parallel to the upper support structures in the extended positions.

EXAMPLE 17

The collapsible device of any of Examples 9 through 16, wherein the upper support structures and lower support structures are configured to extend perpendicularly to a plane defined by the frame in the extended positions, wherein the upper and lower support structures are configured to extend parallel to the plane in the retracted positions.

EXAMPLE 18

The collapsible device of any of Examples 12 through 17, wherein the frame contains an opening located adjacent to the lower portion, wherein the first end base and the second end base are configured to slide into the opening in the retracted position and slide out of the opening in the extended position.

EXAMPLE 19

The collapsible device of any of Examples 12 through 18, wherein the first end base and the second end base are coupled to the frame by a hinge such that the end bases are configured to pivot downwardly away from the frame when transitioning from the retracted position to the extended position, wherein each of the end bases is further configured to pivot upwardly towards the frame when transitioning from the extended position to the retracted position.

EXAMPLE 20

A collapsible device for holding at least one container comprising: (a) a frame; (b) a pair of upper support structures coupled to an upper portion of the frame, wherein each upper support structure is configured to pivot relative to the frame between a retracted position and an extended position, wherein each upper support structure includes at least one ring member, wherein each ring member defines a circular opening configured to receive a container when the corresponding upper support structure is in the extended position; (c) a pair of lower support structures coupled to a lower portion of the frame, wherein each lower support structure is configured to pivot relative to the frame between a retracted position and an extended position; and (d) a handle coupled to the frame, wherein the handle is movable relative to the frame independently of the upper support structures and the lower support structures between an extended position and a retracted position; wherein the upper support structures and the lower support structures in the extended positions are configured to cooperate to support a pair of containers; wherein each upper support structure is configured to overlap with a respective lower support structure when the upper and lower support structures are in the retracted position; wherein the handle in the extended position is configured to be grasped by a user to transport the collapsible device with the upper support structures and the lower support structures in the extended position.

EXAMPLE 21

The collapsible device of any of the preceding Examples, wherein the device is configured to support and carry at least one container selected from the group consisting of glass bottles, aluminum cans, plastic bottles, styrofoam cups, and paper cups. The device may support and carry one or more types of containers at the same time.

EXAMPLE 22

The collapsible device of any of the preceding Examples, wherein the frame, handle, upper support structure, and lower support structure are made out of a material selected from the group consisting of plastic, metal, and wood. The material used, whether it be plastic, metal, or wood, needs to have sufficient strength to support multiple containers full of liquid without breaking. The metal used could be aluminum, iron, steel, bronze, or another metal not mentioned here.

EXAMPLE 23

The collapsible device of any of the preceding Examples, wherein the frame, handle, upper support structure, and lower support structure are made out of a material strong enough to support the necessary weight.

EXAMPLE 24

The collapsible device of any of the preceding Examples, wherein each upper support structure has three or less ring members.

EXAMPLE 25

The collapsible device of any of the preceding Examples, wherein the upper support structures extend from the retracted position first and the lower support structures extend from the retracted position second. Additionally, the lower support structures retract to the frame first and the upper support structures retract to the frame second.

IV. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A collapsible device for holding at least one container, comprising:

a. a frame defining a frame plane;

b. a pair of upper support structures coupled to an upper portion of the frame, wherein each upper support structure is configured to pivot relative to the frame between a retracted position and an extended position, wherein each upper support structure includes at least one ring member, wherein each ring member defines a circular opening configured to receive a container when the corresponding upper support structure is in the extended position;

c. a pair of lower support structures coupled to a lower portion of the frame, wherein each lower support structure is configured to pivot relative to the frame between a retracted position and an extended position; and d. a handle coupled to the frame, wherein the handle is movable relative to the frame independently of the upper support structures and the lower support structures between an extended position and a retracted position, wherein the upper support structures and the lower support structures in the extended positions are configured to cooperate to support at least one container, wherein each upper support structure is configured to overlap with a respective lower support structure in a respective support structure plane that is offset from the frame plane when the upper and lower support structures are in the retracted positions, wherein the handle in the extended position is configured to be grasped by a user to transport the collapsible device with the upper support structures and the lower support structures in the extended position.

2. The collapsible device of claim 1, wherein the frame includes a first channel adjacent to a first end of the frame and a second channel adjacent to a second end of the frame, wherein the handle is slidable along the first and second channels.

3. The collapsible device of claim 1, wherein each of the lower support structures is configured to pivot downwardly away from the frame when transitioning from the retracted position to the extended position, wherein each of the lower support structures is further configured to pivot upwardly towards the frame when transitioning from the extended position to the retracted position.

4. The collapsible device of claim 3, wherein each of the upper support structures is configured to pivot upwardly away from the frame when transitioning from the retracted position to the extended position, wherein each of the upper support structures is further configured to pivot downwardly towards the frame when transitioning from the extended position to the retracted position.

5. The collapsible device of claim 1, wherein the lower support structures in the extended positions extend parallel to the upper support structures in the extended positions.

6. The collapsible device of claim 1, wherein the handle is slidable along the frame plane between the extended position and the retracted position.

7. The collapsible device of claim 6, wherein the upper support structures and lower support structures are configured to extend perpendicularly to the frame plane in the extended positions, wherein the upper and lower support structures are configured to extend parallel to the frame plane in the retracted position.

8. The collapsible device of claim 1, wherein the at least one ring member includes two ring members.

9. The collapsible device of claim 1, wherein the upper support structures are opposed from one another about the frame plane, wherein the lower support structures are opposed from one another about the frame plane.

10. The collapsible device of claim 9, wherein the upper support structures are configured to pivot in opposite directions from one another when transitioning between the retracted position and the extended position, wherein the lower support structures are configured to pivot in opposite directions from one another when transitioning between the retracted position and the extended position.

11. The collapsible device of claim 10, wherein the upper support structures are configured to pivot away from one another when transitioning from the retracted position to the extended position and toward one another when transitioning from the extended position to the retracted position.

12. The collapsible device of claim 1, wherein each lower support structure is configured to be retained in the retracted position by a corresponding one of the upper support structures in the retracted position such that the lower support structure is configured to pivot from the retracted position to the extended position only after the corresponding upper support structure is pivoted from the retracted position to the extended position.

13. The collapsible device of claim 1, wherein the handle includes an opposed pair of handle sides, wherein when the handle, the upper support structures, and the lower support structures are in the retracted positions each handle side is configured to align flush with a respective upper support structure and a respective lower support structure.

14. The collapsible device of claim 1, wherein each lower support structure further includes a raised lip extending from an outer edge of the lower support structure and having an arcuate shape, wherein the raise lip is configured to engage and retain a bottom portion of a container.

15. A collapsible device for holding at least one container, comprising:

a. a frame;

b. a pair of upper support structures coupled to an upper portion of the frame, wherein each upper support structure is configured to pivot relative to the frame between a retracted position and an extended position, wherein each upper support structure includes at least one ring member, wherein each ring member defines a circular opening configured to receive a container when the corresponding upper support structure is in the extended position;

c. a pair of lower support structures coupled to a lower portion of the frame, wherein each lower support structure is configured to pivot relative to the frame between a retracted position and an extended position; and d. a handle coupled to the frame, wherein the handle is movable relative to the frame independently of the upper support structures and the lower support structures between an extended position and a retracted position, wherein the upper support structures and the lower support structures in the extended positions are configured to cooperate to support a pair of containers, wherein the upper support structures are configured to pivot in opposite directions from one another when transitioning between the retracted position and the extended position, wherein the lower support structures are configured to pivot in opposite directions from one another when transitioning between the retracted position and the extended position, wherein the handle in the extended position is configured to be grasped by a user to transport the collapsible device with the upper support structures and the lower support structures in the extended position.

16. A collapsible device for holding at least one container, comprising:

a. a frame having a first frame side, a second frame side opposed from the first frame side, an upper frame portion, and a lower frame portion;

b. a first upper support structure pivotably coupled with the upper frame portion and disposed on the first frame side;

c. a second upper support structure pivotably coupled with the upper frame portion and disposed on the second frame side;

d. a first lower support structure pivotably coupled with the lower frame portion and disposed on the first frame side;

e. a second lower support structure pivotably coupled with the lower frame portion and disposed on the second frame side; and f. a handle movably coupled with the upper frame portion, wherein each of the first and second upper support structures is configured to pivot relative to the frame in opposite directions from one another between a retracted position and an extended position, wherein each of the first and second lower support structures is configured to pivot relative to the frame in opposite directions from one another between a retracted position and an extended position, wherein the first upper support structure and the first lower support structure in the extended positions are configured to cooperate to support a first container along the first frame side, wherein the second upper support structure and the second lower support structure in the extended positions are configured to cooperate to support a second container along the second frame side.

17. The collapsible device of claim 16, wherein the frame defines a frame plane, wherein the upper and lower support structures in the retracted positions are configured to extend parallel to the frame plane, wherein the upper and lower support structures in the extended positions are configured to extend non-parallel to the frame plane.

18. The collapsible device of claim 16, wherein the first and second upper support structures are configured to pivot away from one another when transitioning from the retracted position to the extended position and toward one another when transitioning from the extended position to the retracted position.

19. The collapsible device of claim 18, wherein the first and second lower support structures are configured to pivot away from one another when transitioning from the retracted position to the extended position and toward one another when transitioning from the extended position to the retracted position.

20. The collapsible device of claim 17, wherein the first upper and lower support structures in the retracted positions are configured to lie within a first support structure plane, wherein the second upper and lower support structures in the retracted positions are configured to lie within a second support structure plane, wherein the first and second support structure planes are offset from the frame plane and are opposed from one another about the frame plane.

* * * * *